United States Patent [19]

Tullman

[11] 4,269,129

[45] May 26, 1981

[54] RETRACTABLE RETAINING DEVICE FOR SEWING MACHINE SUPPORT PLATE

[75] Inventor: Edward J. Tullman, Union, N.J.

[73] Assignee: The Singer Company, Stamford, Conn.

[21] Appl. No.: 63,897

[22] Filed: Aug. 6, 1979

[51] Int. Cl.[3] ..... D05B 75/06

[52] U.S. Cl. ..... 112/257; 112/260; 292/150; 411/437

[58] Field of Search ..... 112/257, 258, 260, 217.1; 292/150; 151/69; 85/80

[56] References Cited

U.S. PATENT DOCUMENTS

| | | | |
|---|---|---|---|
| 2,569,091 | 9/1951 | Robert | 112/260 |
| 2,877,728 | 3/1959 | Enos | 112/260 |
| 3,060,878 | 10/1962 | Johnson | 112/260 |
| 3,227,029 | 1/1966 | Devine et al. | 151/69 X |
| 3,440,987 | 4/1969 | Coulombe | 112/260 |
| 3,571,904 | 3/1971 | Gulistan | 151/69 |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A support plate is removably fastened to a sewing machine bed by a retaining device, which device when not in use may be depressed into a position flush with the sewing machine bed. The retaining device has two stable positions for a latch body having a flange on the upper end thereof which may retain a support plate by overlying a slot thereof.

13 Claims, 5 Drawing Figures

RETRACTABLE RETAINING DEVICE FOR SEWING MACHINE SUPPORT PLATE

DESCRIPTION

BACKGROUND OF THE INVENTION

This invention relates in general to sewing machines; more particularly, it is concerned with a device for selectively retaining a support plate affixed to a sewing machine bed which device, when not in use, will remain substantially flush with the bed.

Recently there have been introduced in the marketplace electronically controlled sewing machines. These electronically controlled sewing machines utilize a solid state memory to retain a record of ornamental patterns and stitch parameters for use in controlling the sewing instrumentalities of the sewing machine. It had been proposed to supplement the solid state memories with auxiliary devices which permit, for example, the application of monograms, or permit a home sewer to initiate her own patterns. With these types of devices, generally an electrical connection must be made with the electronic control means of the sewing machine, and the device must be located convenient to the home sewer so as to be readily manipulated.

What is required is a support plate for these auxiliary devices, together with retractable means for connecting the support plate to the sewing machine which retractable means when retracted provide little or no interference with the flow of work material across the work supporting bed or with the aesthetic appearance of the sewing machine.

SUMMARY OF THE INVENTION

A support plate is provided having a slot in a portion thereof, the slot having an open end for entrance of a latch body having a flange on the upper end thereof spanning the slot for retention of the support plate. The latch body is fashioned with a transverse bore, spaced from the flange, and is slidable in an aperture through the sewing machine bed, the aperture having a double counterbore, the outer of which receives the flange and the inner of which receives an end of a coil compression spring encircling the latch body and biased against the flange to urge it in a direction extended from the bed. When the flange is seated in the outer counterbore the transverse bore in the latch body is situated partially within and partially outside of the aperture through the bed. A latch is slidable in the transverse bore of the latch body and is retained therein by a latch reset pin extending upwardly through the center of the latch body and through a hole in the latch. The end of the latch reset pin adjacent the latch is conically shaped and fits into a taper on the bottom of the latch, this fit causing a portion of the latch to protrude beyond the latch body and externally over the aperture beneath the bed. The latch reset pin is fashioned with a latch cap on the upper end thereof, the latch body being fashioned with a recess to carry an inner coil spring trapped between the latch cap and the recess in order to urge the latch reset pin in an upwardly direction. That portion of the latch extending beyond the aperture in the bed is fashioned as a wedge so that if the latch body is moved upwardly in response to urging of the outer coil spring, the bottom edge of the aperture bears against the wedge and causes the latch to move thus permitting the latch body to rise to an elevated position which will permit the flange to be guided above the slot in the support plate for retention thereof. If the latch body is depressed until the flange is situated within the outer counterbore, the latch is free to move in a direction to have a portion thereof extend beneath the bed and is so urged by the action of the conical end portion of the latch reset pin on the taper on the bottom of the latch. Subsequent elevation of the latch body to a support plate retaining position is effected by depressing the latch cap of the latch reset pin so as to permit the latch to once again be urged to a position by the bed which will permit the latch body and the latch to be elevated within the aperture in the bed.

DESCRIPTION OF THE DRAWINGS

The invention comprises the devices, combinations and arrangements of parts hereinafter set forth and illustrated in the accompanying drawings of a preferred embodiment of the invention, from which the several features of the invention and the advantages attained thereby will be readily understood by those skilled in the art.

DESCRIPTION OF THE PREFERRED EMBODIMENT

Figures 1, 2:
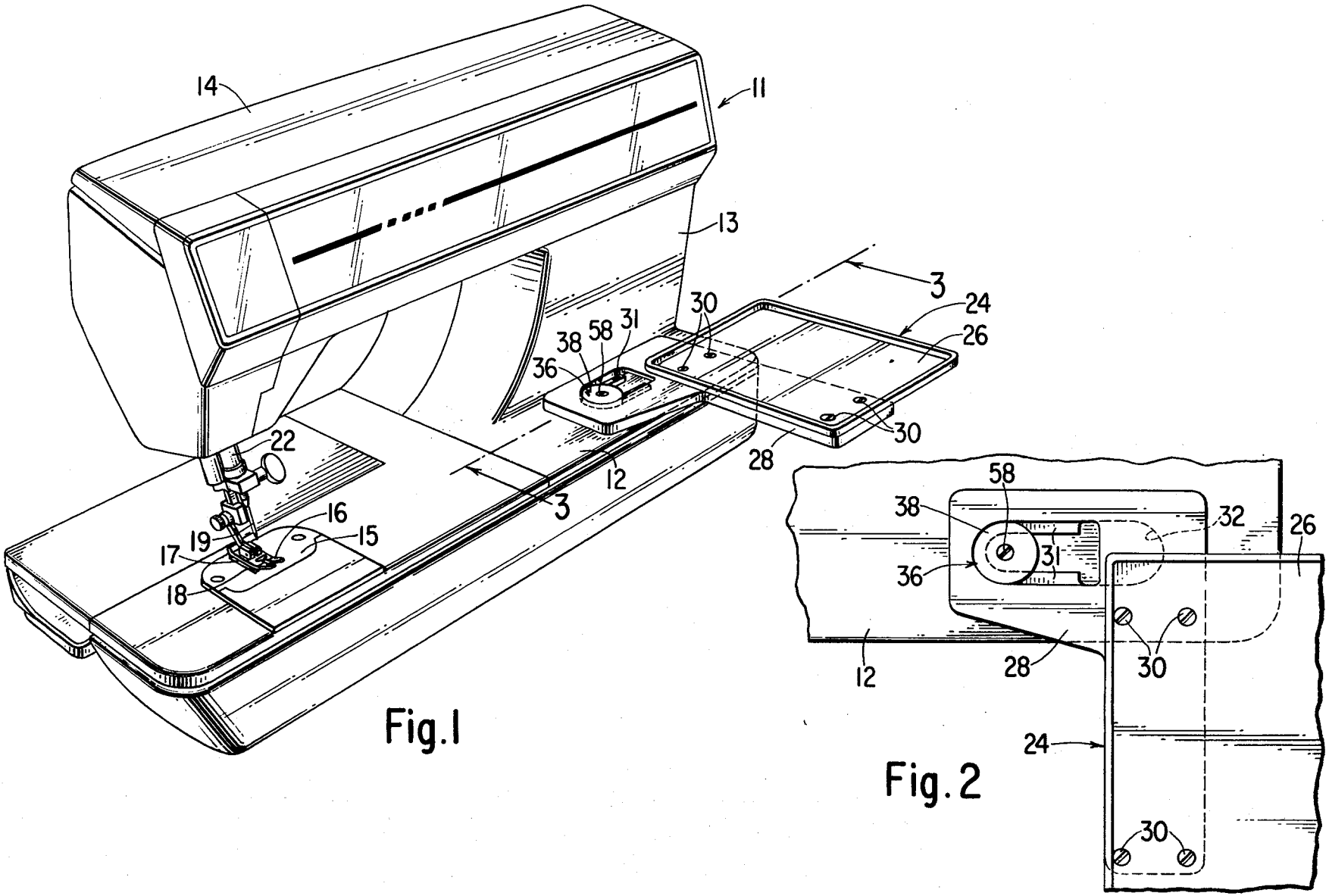
FIG. 1 is a perspective view of a sewing machine of the type used in combination with the present invention, showing the support plate and retaining means thereon.
FIG. 2 is a plan view of a portion of the sewing machine shown in FIG. 1 to show portions of the support plate and the retaining means thereof.

Referring to FIG. 1 of the drawings, a sewing machine 11 includes a work supporting bed 12 from which rises a standard 13 which sustains a bracket arm 14 overhanging the bed. A throat plate 15 carried on the bed supports the thrust of a spring-loaded presser device 16 carried in the bracket arm. Work fabrics to be stitched are urged by the presser device 16 downwardly against the throat plate 15 and against work feed dog 17 which work upwardly through slots 18 in the throat plate to feed the work fabric. The presser device 16 and throat plate 15 are apertured to accommodate the reciprocation of a needle 19 carried on the end of a needle bar 22, which needle bar is supported in the bracket arm 14 for endwise reciprocation and lateral oscillation in a manner well known in the sewing machine art.

The standard 13 and bracket arm 14 of the sewing machine 11 support, internally thereof, an electronic control arrangement similar to that disclosed in U.S. Pat. No. 3,984,745, issued on Oct. 5, 1976 to Minalga, which patent is assigned to the same assignee as the instant invention, and which is hereby incorporated by reference herein. In that patent there is disclosed a sewing machine having a solid state memory for retaining ornamental pattern information and other operating information for the sewing machine, the stitch pattern information of which is transferred to servo systems for positioning of the needle bar 22 and sewing needle 19 attached thereto, and for positioning a work feed regulator in order to control the rate and direction of feed of work fabric by feed dog 17. The subject of the instant invention is an arrangement by which auxiliary devices may be supported by the bed 12 of the sewing machine 11 in a fashion to be readily accessible to the operator of the sewing machine. Such a device is disclosed in the U.S. Pat. No. 4,085,691 of Coughenour et al, which is hereby incorporated by reference herein. In that patent there is disclosed an auxiliary device which may be electrically connected to an electronically controlled sewing machine and which may convert operator input data into a form usable by the sewing machine in the formation of operator derived stitch patterns. There is also the U.S. Pat. No. 4,092,938 of Coughenour et al, which is hereby incorporated by reference herein, which discloses an auxiliary means for entering stitch pattern information in digital form into a separate memory which may then be used to control the electronic instrumentalities of the sewing machine. See also the U.S. Pat. No. 4,144,827 of Brown which is hereby incorporated by reference herein, which patent discloses a switch array having means for increasing the amount of information which may be entered therein in order, for example, to permit the monogramming of long names. Each of the above devices may be electrically connected to the sewing machine 11 by plug connections on the side or back of the sewing machine and they may be supported on a support plate 24 shown in FIGS. 1 and 2, which support plate may be retained to the bed of the sewing machine by the retaining device 35.

The support plate 24 may be fabricated with a tray 26 on which the auxiliary devices disclosed in the above referenced patents may be supported. The tray 26 may be fastened to an L-bracket 28 by screws 30. Alternatively, it is apparent that a single piece construction may be substituted for the two piece construction herein disclosed. The L-bracket 28 is recessed and slotted as at 31 and undercut as at 32 to open end the slot 31 and provide access thereto. The recessed slot 31 may be further tapered downwardly to the sewing machine bed 12 for a purpose which will become apparent (see FIG. 3).

Figure 3:
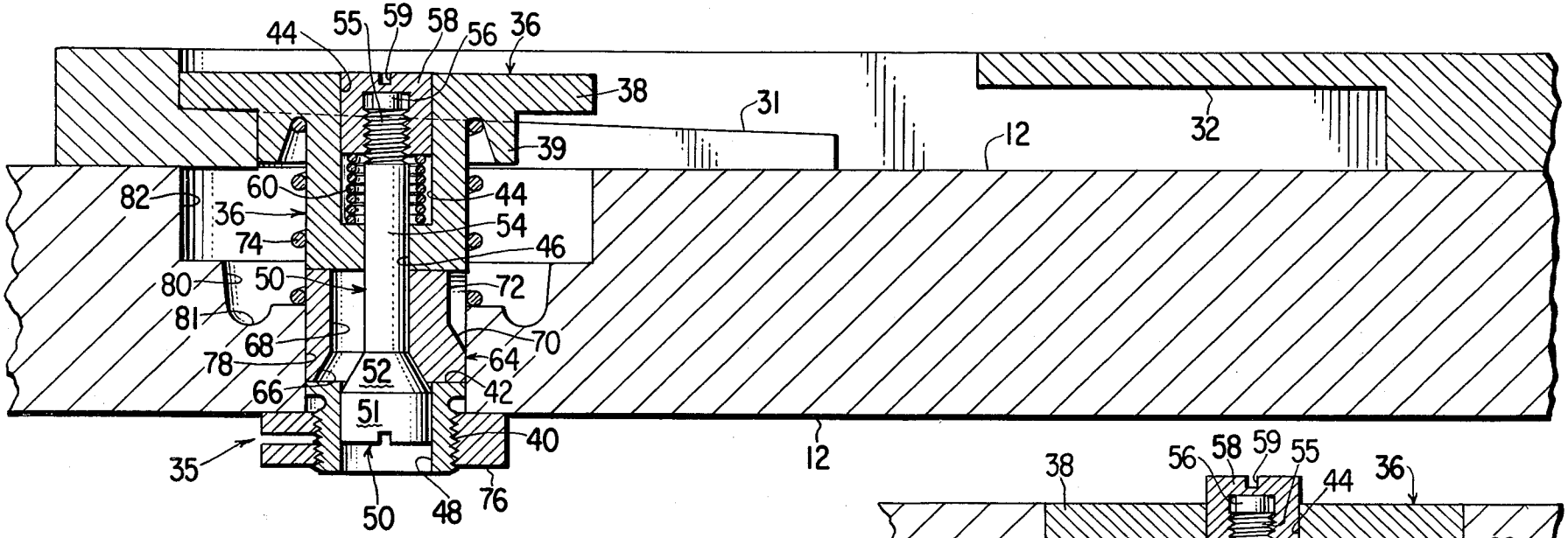
FIG. 3 is a cross-sectional view taken substantially along the line 3—3 of FIG. 1 showing the details of the retaining means thereof while in a position to retain said support plate.
Figure 4:
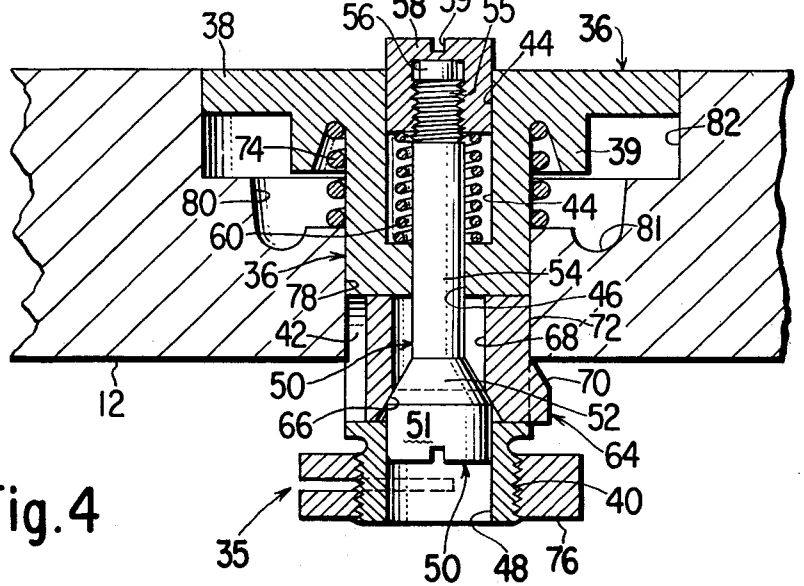
FIG. 4 is a view similar to FIG. 3 showing however, the retaining means in the retracted position thereof; and, FIG. 5 is an exploded perspective view of the retaining means shown in FIGS. 3 & 4.
Figure 5:
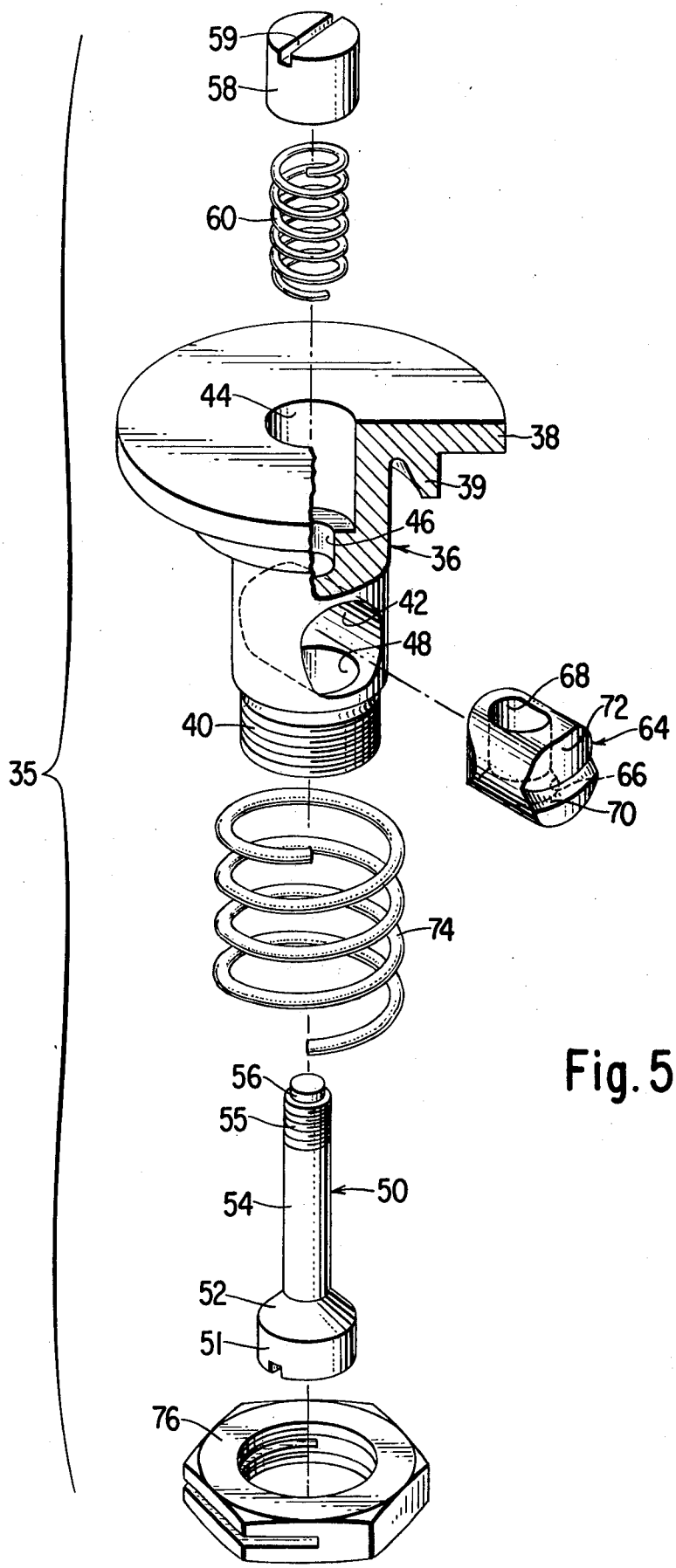

Referring now to FIGS. 3, 4 and 5 there is shown in cross-section the retaining device 35, respectively, in the operative position, in the stored position and an exploded view. The retaining device 35 is formed with a latch body 36 having a flange 38 on the upper end thereof, a male thread 40 on the lower end thereof and a transverse bore 42 immediately above the male thread 40. The latch body 36 is formed with an axial counterbore 44 through the flange 38, and axial hole 46 from the counterbore to the transverse bore 42 and an enlarged axial hole 48 internally of the male thread 40. A latch reset pin 50 is fashioned with a large head 51 which slidably fits into the enlarged axial hole 48, the head tapering off in a transition zone 52 to a body 54 which extends through the axial hole 46, the body terminating in a threaded end 55. A latch cap 58 is fashioned with internal threads to match the threaded end 55 of the latch reset pin 50, and is further fashioned with an external slot 59 to facilitate attachment of the latch cap to the latch reset pin. A button 56 may be provided on the end of the latch reset pin 50 for the latch cap 58 to impinge upon in order to provide a degree of clamping force therefor. An inner coil spring 60 surrounds the latch reset pin 50 and is trapped between the axial counterbore 44 of the latch body 36 and the end of the latch cap 58. The transverse bore 42 of the latch body 36 slidably supports a latch 64 therein, the latch having a countersink 66 at the bottom end thereof, the countersink matching the transition zone 52 of the latch reset pin 50. The countersink 66 terminates in an enlarged bore 68 through which the body 54 of the latch reset pin 50 passes. The latch 64 is transversely shiftable above the latch reset pin 50 from where the countersink 66 lies in contact with the transition zone 52 of the latch reset pin 50 on one or the other side thereof. The lower part of the latch 64 is the same diameter as the latch body 36, the latch tapering down in a wedge area 70 to an upper area of reduced cross-section 72.

The flange 38 of the latch body 36 is fashioned with an inwardly directed skirt 39, which skirt contains therein one end of an outer coil spring 74 encircling the outside of the latch body. The retaining device 35 is complete with the split nut 76 carried on the male thread portion 40 of the latch body 36 and used to fix the device to the bed 12.

Referring to FIG. 3 the retaining device 35 is supported in an area of the sewing machine bed 12 which has no supporting ribs therebeneath. In this area the bed 12 contains a through bore 78 with a double counterbore, the inner counterbore 80 being fashioned with a relief 81 to accommodate the skirt 39 of the latch body 36. The outer counterbore 82 is designed to receive the flange 38 of the latch body 36 when the retaining device 35 is in a stored position. By referring to FIG. 3 it can be seen that the outer coil spring 74 rests upon the inner counterbore 80, thus to urge the latch body 36 into an elevated position. With the flange 38 in an elevated position, the L-bracket 28 of the support plate 24 may have the recessed slot 31 slid beneath the flange in order to retain the support plate fixed to the sewing machine 11. The split nut 70 retains the retaining device 35 and support plate 24 fixed to the bed. In this operating position of the retaining device 35, the latch 64 has moved to the left as viewed in FIG. 3 so that the through bore 78 in the bed 12 may accommodate the latch. If the support plate 24 were to be removed, and the flange 38 were to be depressed into the outer counterbore 82, the latch body 36 would be depressed and the latch 64 would extend partially below the bed 12 and be free to partake of limited transverse motion. Accordingly, the inner coil spring 60 would elevate the latch reset pin 50 causing the transition zone 52 thereof to force the latch 64 in a rightward direction until the transition zone is centered on the countersink 66. With the transition zone 52 of the latch reset pin 50 centered on the countersink 66 of the latch 64, the wedge area 70 thereof extends beyond the through bore 78 to beneath the bed 12, thereby restricting upward motion of the latch body 36 because the outer coil spring 74 is unable to overcome the force of the inner coil spring 60 imposed through the wedge surfaces provided by the transition zone and the countersink. Thus, the retaining device 35 is in a stored position wherein the flange 38 is flush with the top surface of the bed 12 and only the latch cap 58 extends therefrom a small amount for convenient manipulation thereof. Alternatively, the latch cap 58 may be made flush with the flange 38, to be actuated by depression below the level of the flange. It will be apparent that if the latch cap 58 is depressed, the transition zone 52 of the latch reset pin 50 is removed from equal engagement with the countersink 66 of the latch 64, and the latch 64 will move to the left because of the force of the outer coil spring 74 on the latch body 36 urging the latch body and latch 64 upwardly, causing a reaction with the wedge area 70 which will move the latch to the left. The latch body 36 will move upwardly until impeded from further movement by the split nut 76 impinging upon the bottom of the sewing machine bed 12. The split nut 76 may be used to tighten the action of the flange 38 upon the recessed slot 31 in the support plate 24, so that the flange tightly presses the L-bracket 28 against the bed 12 and, by reason of the increased thickness of the slot material, before the closed end of the slot is reached.

It will be apparent to those skilled in the art that the latch body 36 need not terminate in a flange 38. Alternatively, the latch body 36 may have an aperture at its extremity through which an appendage of the support plate may extend or the latch body 36 may terminate in a hook. Other changes may also be made in the form of the attachment member without departing from the invention claimed.

I claim:

1. A sewing machine comprising a frame including a bed and an arm overhanging said bed, said bed having a flat work supporting surface and supporting internally thereof sewing instrumentalities including a looptaker, said arm supporting an endwise reciprocating needle bar carrying on an end thereof a sewing needle for cooperation with said looptaker in the formation of stitches, and means supported in said bed for retaining a plate for supporting auxiliary devices, said retaining means having a retaining portion held by a latch device at a selected one of two stable positions including a first stable position substantially flush with said work supporting bed and a second stable position exposing said retaining portion for retaining said supporting plate.

2. A sewing machine as claimed in claim 1 wherein said retaining portion is implemented by a latch body, said latch body having a transverse bore therethrough; and wherein said retaining means further comprises an outer resilient means urging said latch body to an exposed retaining position, a latch shiftably carried in said transverse bore of said latch body, means for urging said latch to a position extending from said latch body, said urging means including means for inhibiting retraction of said latch when extended from said bore and operator selectable means for disengaging said inhibiting means, means effective when said latch body is in a substantially flush position for receiving said extended latch and retaining said latch body in said substantially flush position against the urgings of said outer resilient means, and means effective when said latch body is in a substantially flush position for exerting a force upon said latch returning said latch to within said bore in said latch body.

3. A sewing machine as claimed in claim 2 wherein said urging means for said latch further comprises: a latch reset pin extending through said latch and latch body transversely of said transverse bore therethrough, said latch reset pin being capable of limited movement with respect to said latch body transversely of said transverse bore, said latch being capable of limited movement on said latch reset pin with respect to said latch body in said transverse bore thereof, resilient means extending between said latch reset pin and said latch body for impelling said latch reset pin in a preferred direction with respect to said latch body, said latch reset pin and said latch having interacting surfaces for influencing extending motion of said latch in said transverse bore when said latch reset pin is impelled in said preferred direction.

4. A sewing machine as claimed in claim 3 wherein said interacting surfaces of said latch reset pin and said latch are implemented by a conical frustrum of a cone on said latch reset pin and by a countersink on said latch, said latch having an enlarged aperture to which said countersink converges, said enlarged aperture encircling said latch reset pin for accommodating limited shiftable motion of said latch.

5. A sewing machine as claimed in claim 4 wherein said conical frustrum of said latch reset pin is engaged with one side of said countersink on said latch when said latch is positioned within said transverse bore of said latch body thereby urging said latch to an extending position, and wherein said conical frustrum of said latch reset pin is coaxial with said countersink in said latch when said latch is in a position fully extended from said latch body thereby inhibiting retraction of said latch.

6. A sewing machine as claimed in claim 5 wherein said bed is formed with an aperture therethrough, and wherein said latch body is slidably supported within said aperture so that with said latch body in said substantially flush position said latch extends partially from said aperture in a portion extending beneath said bed, said portion flaring gradually away from said aperture to form a wedge, whereby action of said outer resilient means urging said latch body to an exposed position exerts a force upon said latch for returning said latch to within said bore in said latch body, thus implementing said force exerting means, and whereby said latch extending partially beneath said bed implements said extended latch receiving means.

7. A sewing machine as claimed in claim 6 wherein said operator selectable means for disengaging said inhibiting means is implemented by an operator touch surface on said latch reset pin onto which the imposition of force by an operator in excess of the force exerted by said resilient means will urge said latch reset pin in a direction opposite to said preferred direction and separate said interacting surfaces of said latch reset pin and said latch, whereby said latch is free to move in response to said force exerting means.

8. A retaining device for movement of a retaining portion thereof from a position substantially flush with a surface to a position exposing said retaining portion for a retaining purpose, said surface having an aperture for receiving said retaining device, said retaining device comprising a latch body having a transverse bore therethrough, an outer resilient means urging said latch body to an exposed retaining position, a latch shiftably carried in said transverse bore of said latch body, means for urging said latch to a position extending from said latch body, said urging means including means for inhibiting retraction of said latch when extended from said bore an operator selectable means for disengaging said inhibiting means, means effective when said latch body is in a substantially flush position for receiving said extended latch and retaining said latch body in said substantially flush position against the urgings of said outer resilient means, and means effective when said latch body is in a substantially flush position for exerting a force upon said latch returning said latch to within said bore in said latch body.

9. A retaining device as claimed in claim 8 wherein said urging means for said latch further comprises a latch reset pin extending through said latch and latch body transversely of said transverse bore therethrough, said latch reset pin being capable of limited movement with respect to said latch body transversely of said transverse bore, said latch being capable of limited movement on said latch reset pin with respect to said latch body in said transverse bore thereof, resilient means extending between said latch reset pin and said latch body for impelling said latch reset pin in a preferred direction with respect to said latch body, said latch reset pin and said latch having interacting surfaces for influencing extending motion of said latch in said transverse bore when said latch reset pin is impelled in said preferred direction.

10. A retaining device as claimed in claim 9 wherein said interacting surfaces of said latch reset pin and said latch are implemented by a conical frustrum of a cone on said latch reset pin and by a countersink on said latch, said latch having an enlarged aperture to which said countersink converges, said enlarged aperture encircling said latch reset pin for accommodating limited shiftable motion of said latch.

11. A retaining device as claimed in claim 10 wherein said conical frustrum of said latch reset pin is engaged with one side of said countersink on said latch when said latch is positioned within said transverse bore of said latch body thereby urging said latch to an extending position, and wherein said conical frustrum of said latch reset pin is coaxial with said countersink in said latch when said latch is in a position fully extended from the latch body thereby inhibiting retraction of said latch.

12. A retaining device as claimed in claim 11 wherein said aperture in said surface extends therethrough, and wherein said latch body is slidably supported within said apertures so that with said latch body in said substantially flush position said latch extends partially from said aperture in a portion extending beneath said surface, said portion flaring gradually away from said aperture to form a wedge, wherein action of said outer resilient means urging said latch body to an exposed position exerts a force upon said latch for returning said latch to within said bore and said latch body, thus implementing such force exerting means, and whereby said latch extending partially beneath said surface implements said extended latch receiving means.

13. A retaining device as claimed in claim 12 wherein said operator selectable means for disengaging said inhibiting means is implemented by an operator touch surface on said latch reset pin onto which the imposition of force by an operator in excess of the force exerted by said resilient means will urge said latch reset pin in a direction opposite to said preferred direction and separate said interacting surfaces of said latch reset pin and said latch, whereby said latch is free to move in response to said force exerting means.

* * * * *